US012799930B2

(12) United States Patent
White et al.

(10) Patent No.: US 12,799,930 B2
(45) Date of Patent: Nov. 17, 2026

(54) COMPRESSOR WITH HOUSING-INTEGRATED AIR STORAGE DEVICE

(71) Applicant: Robert Bosch GmbH, Stuttgart (DE)

(72) Inventors: Daniel White, Bettendorf, IA (US); Jeremy Rubens, Palatine, IL (US); Walter Bernardi, Highland Park, IL (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 19/181,792

(22) Filed: Apr. 17, 2025

(65) Prior Publication Data

US 2026/0168485 A1 Jun. 18, 2026

Related U.S. Application Data

(60) Provisional application No. 63/636,342, filed on Apr. 19, 2024.

(51) Int. Cl.
*F04B 35/04* (2006.01)
*F04B 53/10* (2006.01)

(52) U.S. Cl.
CPC ..... *F04B 35/04* (2013.01); *F04B 53/10* (2013.01)

(58) Field of Classification Search
CPC ..... F04B 35/06; F04B 41/02; B25C 1/04
See application file for complete search history.

(56) References Cited

U.S. PATENT DOCUMENTS

| | | | | |
|---|---|---|---|---|
| 5,686,041 | A | 11/1997 | Ally | |
| 9,352,933 | B2 * | 5/2016 | Moore | B65H 75/4478 |
| 10,259,110 | B2 | 4/2019 | Bruggmueller et al. | |
| 10,584,811 | B2 | 3/2020 | Garrett et al. | |
| 11,519,527 | B2 | 12/2022 | Gruel et al. | |
| 2014/0090732 | A1 | 4/2014 | Schieler et al. | |
| 2015/0308425 | A1 * | 10/2015 | Skotty | F04B 35/04 417/63 |

OTHER PUBLICATIONS

Jayco Polyurethane Coiled Air Hose Kit, Amazon, Dec. 15, 2024.
Milwuakee Inflator, Home Depot Online, Feb. 16, 2024.

* cited by examiner

*Primary Examiner* — Kenneth J Hansen
(74) *Attorney, Agent, or Firm* — Maginot, Moore & Beck LLP

(57) ABSTRACT

A power tool compressor is connected to a flexible tubular compressed air storage device. The housing of the compressor includes an integrated spool. The spool is configured to receive and store loops of the tubular storage device, which is wrapped around the spool. The spool rotatably surrounds a central portion of the compressor housing that encloses a compressor pump and rechargeable battery. The tubular storage device has an internal space that extends between opposed ends of the device. The internal space of the tubular storage device has the volume necessary for storing compressed air for driving the power tool. The integrated spool permits the tubular compressed air storage device to be reeled thereon for easy use, storage and transport, resulting in a compact and light weight compressed air storage solution.

18 Claims, 3 Drawing Sheets

COMPRESSOR WITH HOUSING-INTEGRATED AIR STORAGE DEVICE

BACKGROUND

Air compressors are commonly used to power a wide range of pneumatic or air-powered tools. Some of the power tools that can be operated using an air compressor include nail guns, impact wrenches, air ratchets, air hammers, drills, sanders and grinders, spray guns, staple guns, et cetera. These are just a few examples of power tools that can be operated using an air compressor. The advantage of pneumatic tools is that they often provide high power and durability while being relatively lightweight and easy to handle. However, air compressors may include a tank to pressurize air and for storage of the pressurized (e.g., compressed) air. Such compressors typically use metal storage tanks that are large, bulky and heavy. This makes them difficult to move and store.

SUMMARY

In some aspects, a power tool compressor is connected to a flexible tubular compressed air storage device instead of a rigid compressed air storage tank. The compressor includes a compressor housing having an integrated spool. The spool is rotatable relative to a central portion of the compressor housing and is configured to receive and store loops of the tubular storage device, which is wrapped around the spool. The spool surrounds the central portion of the compressor housing and is rotatable with respect to the central portion of the compressor housing, which encloses a compressor pump and rechargeable battery. The tubular storage device has an internal space that extends between and communicates with couplings disposed at opposed ends of the device. The internal space of the tubular storage device has the volume necessary for storing compressed air used to drive the power tool. Instead of a rigid, large diameter storage device, this embodiment uses a long length of flexible tubing with a relatively smaller diameter to store compressed air. In addition, the integrated spool permits the tubular compressed air storage device to be reeled thereon for easy use, storage and transport, resulting in a compact and light weight compressed air storage solution.

In some aspects, an air compressor includes a compressor housing and a compressor pump disposed in the compressor housing. The compressor pump has an air inlet and an air outlet. The air compressor includes a motor disposed in the compressor housing. The motor is connected to the compressor pump and is configured to drive the compressor pump. The air compressor includes a pressure regulation device disposed in the compressor housing and an air intake valve that is connected to the air inlet of the compressor pump via a first fluid line. The air intake valve is configured to selectively permit air flow from an environment of the compressor to the compressor pump. In addition, the air compressor includes an air exhaust valve that is connected to the air outlet of the compressor pump via a second fluid line. The air exhaust valve is configured to selectively permit air flow from the compressor pump to an air storage device. The compressor housing includes a hollow first cylindrical portion that receives and supports the compressor pump and the pressure regulation device. The first cylindrical portion includes a housing first end, a housing second end opposite the housing first end, and a cylindrical housing sidewall that extends between the housing first end and the housing second end. A height dimension of the first cylindrical portion corresponds to a distance between the housing first end and the housing second end. The compressor housing includes a housing first flange disposed between the housing first end and a mid-height of the first cylindrical portion. The housing first flange protrudes outward from the housing sidewall and extends along the circumference of the housing sidewall. The compressor housing includes a housing second flange disposed between the housing second end and a mid-height of the first cylindrical portion. The housing second flange protrudes outward from the housing sidewall and extends along the circumference of the housing sidewall. In addition, the compressor housing includes a spool that is rotatably supported on the compressor housing.

In some embodiments, the spool includes a hollow second cylindrical portion that surrounds the housing sidewall. The second cylindrical portion includes a spool first end, a spool second end opposite the spool first end, and a cylindrical spool sidewall that extends between the spool first end and the spool second end. A height dimension of the second cylindrical portion corresponds to a distance between the spool first end and the spool second end. The spool includes a spool first flange disposed between at the spool first end and a mid-height of the second cylindrical portion. The spool first flange protrudes outward from the spool sidewall and extends along at least a portion of the circumference of the spool sidewall. The spool includes a spool second flange disposed between the spool second end and a mid-height of the second cylindrical portion. The spool second flange protrudes outward from the spool sidewall and extends along at least a portion of the circumference of the spool sidewall. The second cylindrical portion is concentric with the first cylindrical portion, and the spool first flange, the second cylindrical portion and the spool second flange are disposed between the housing first flange and the housing second flange.

In some embodiments, the spool second flange includes a through hole that is shaped and dimensioned to receive a tube of a compressed air storage device in a clearance fit.

In some embodiments, the housing second flange is disposed at the housing second end, the spool sidewall includes a first through opening that is disposed between the spool second flange and the spool second end, the spool second flange includes a second through opening, and the first through opening and the second through opening are configured to receive a tube of a compressed air storage device in a clearance fit.

In some embodiments, a human machine interface (HMI) that is supported on an outer surface of the housing first end and a controller is disposed in the compressor housing. The controller is electrically connected to the HMI and is configured to control operation of the compressor pump based on inputs received from the HMI.

In some embodiments, the second coupling is a quick connect coupling.

In some embodiments, the first coupling permits a 360 degree swivel between the air exhaust valve and the tube.

In some embodiments, the air compressor is powered by a rechargeable battery disposed in the compressor housing.

In some embodiments, the air compressor is powered by a wired connection to utility power.

In some aspects, an air compressor system includes a compressor housing and a compressor pump disposed in the compressor housing. The compressor pump has an air inlet and an air outlet. The air compressor system includes a motor disposed in the compressor housing. The motor is connected to the compressor pump and is configured to drive the compressor pump. The air compressor system includes a pressure regulation device disposed in the compressor housing. The air compressor system includes an air intake valve that is connected to the air inlet of the compressor pump via a first fluid line, the air intake valve configured to selectively permit air flow from an environment of the compressor to the compressor pump. The air compressor system includes an air exhaust valve that is connected to the air outlet of the compressor pump via a second fluid line. The air exhaust valve is configured to selectively permit air flow from the compressor pump to an air storage device. In addition, the air compressor system includes the air storage device. The compressor housing includes a hollow first cylindrical portion which receives and supports the compressor pump and the pressure regulation device. The first cylindrical portion includes a housing first end, a housing second end opposite the housing first end, and a cylindrical housing sidewall that extends between the housing first end and the housing second end. A height dimension of the first cylindrical portion corresponds to a distance between the housing first end and the housing second end. The compressor housing includes a housing first flange disposed between the housing first end and a mid-height of the first cylindrical portion. The housing first flange protrudes outward from the housing sidewall and extends along the circumference of the housing sidewall. In addition, the compressor housing includes a housing second flange disposed between the housing second end and a mid-height of the first cylindrical portion. The housing second flange protrudes outward from the housing sidewall and extends along the circumference of the housing sidewall. The air outlet valve is supported on the housing second end. The air storage device includes an elongate tube having a device first end that is detachably coupled to the air outlet valve via a first coupling and a device second end that is opposite the device first end. The device second end includes a second coupling. The tube has sufficient flexibility to bend into a loop having a radius that corresponds to a radius of the housing sidewall.

In some embodiments, the air compressor system includes a spool that is rotatably supported on the compressor housing. The spool includes a hollow second cylindrical portion that surrounds the housing sidewall. The second cylindrical portion includes a spool first end, a spool second end opposite the spool first end, and a cylindrical spool sidewall that extends between the spool first end and the spool second end. A height dimension of the second cylindrical portion corresponds to a distance between the spool first end and the spool second end. The spool includes a spool first flange disposed between at the spool first end and a mid-height of the second cylindrical portion. The spool first flange protrudes outward from the spool sidewall and extends along at least a portion of the circumference of the spool sidewall. In addition, the spool includes a spool second flange disposed between the spool second end and a mid-height of the second cylindrical portion. The spool second flange protrudes outward from the spool sidewall and extends along at least a portion of the circumference of the spool sidewall. The second cylindrical portion is concentric with the first cylindrical portion, and the spool first flange and the spool second flange are disposed between the housing first flange and the housing second flange.

In some embodiments, the spool second flange includes a through hole that is shaped and dimensioned to receive a tube of a compressed air storage device in a clearance fit.

In some embodiments, the housing second flange is disposed at the housing second end, the spool sidewall includes a first through opening that is disposed between the spool second flange and the spool second end, the spool second flange includes a second through opening, and the first through opening and the second through opening are configured to receive a tube of a compressed air storage device in a clearance fit.

In some embodiments, the air compressor system includes a human machine interface (HMI) that is supported on an outer surface of the housing first end and a controller disposed in the compressor housing. The controller is electrically connected to the HMI and configured to control operation of the compressor pump based on inputs received from the HMI.

In some embodiments, the second coupling is a quick connect coupling.

In some embodiments, the first coupling permits a 360 degree swivel between the air exhaust valve and the tube.

In some embodiments, the air compressor is powered by a rechargeable battery disposed in the compressor housing.

In some embodiments, the air compressor is powered by a wired connection to utility power.

DETAILED DESCRIPTION

Figure 1:
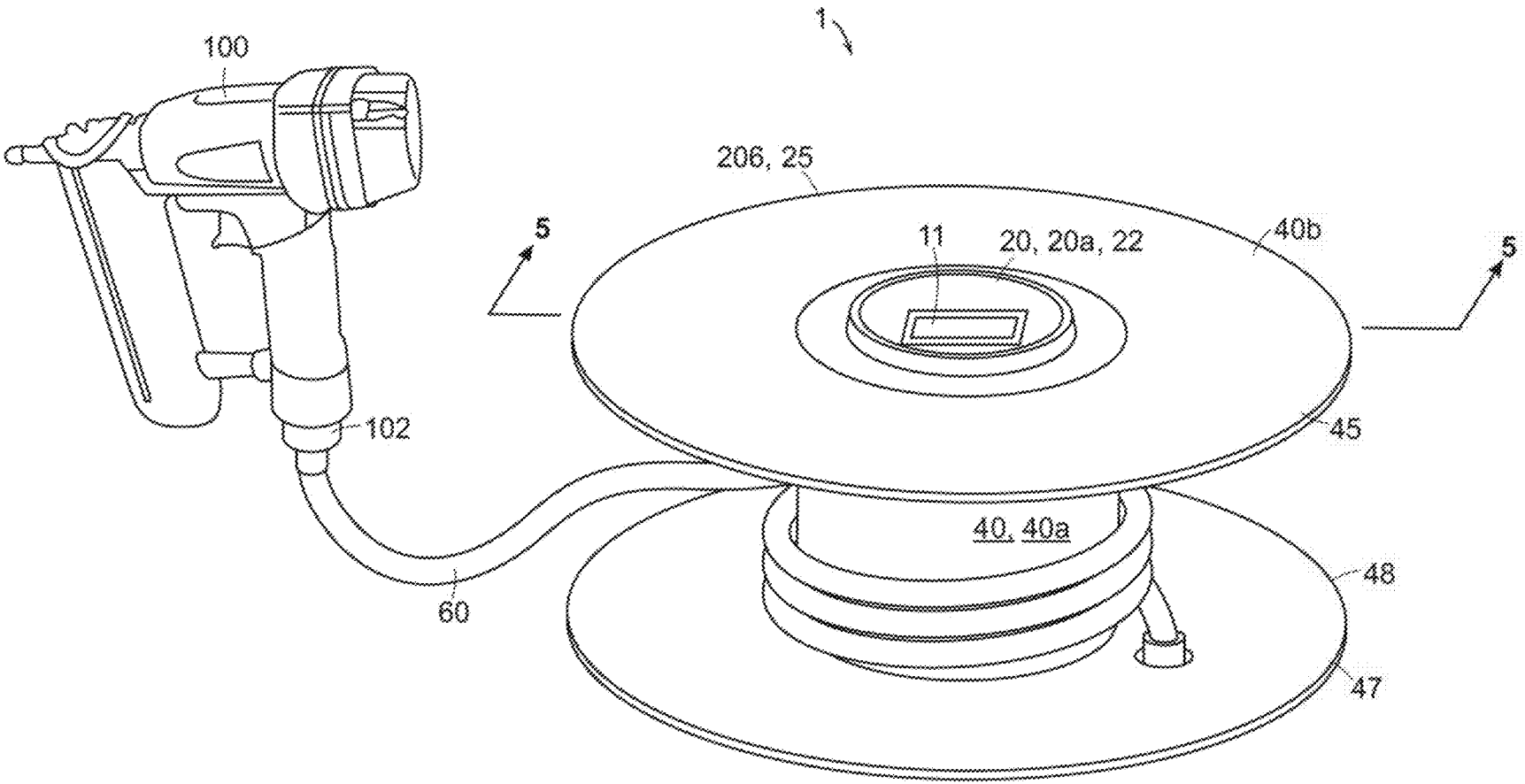
FIG. 1 is a perspective view of system for supplying compressed air to a hand-held power tool.
Figure 2:
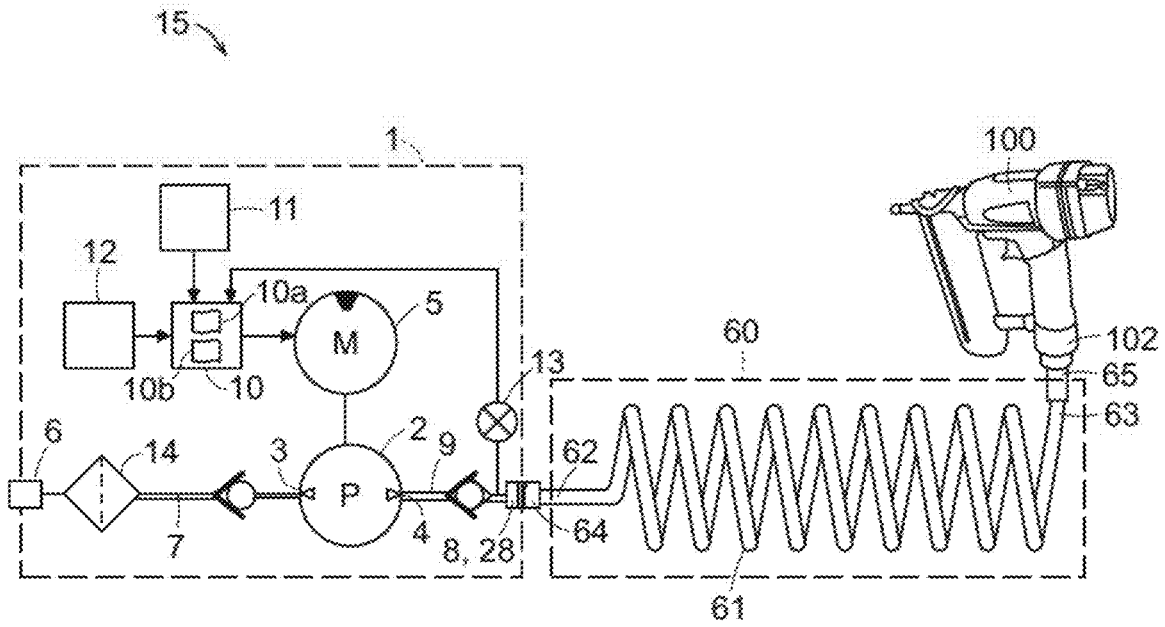
FIG. 2 is a schematic diagram of the system of FIG. 1 in which a single line represents an electrical connection and a double line represents a fluid connection.
Figure 3:
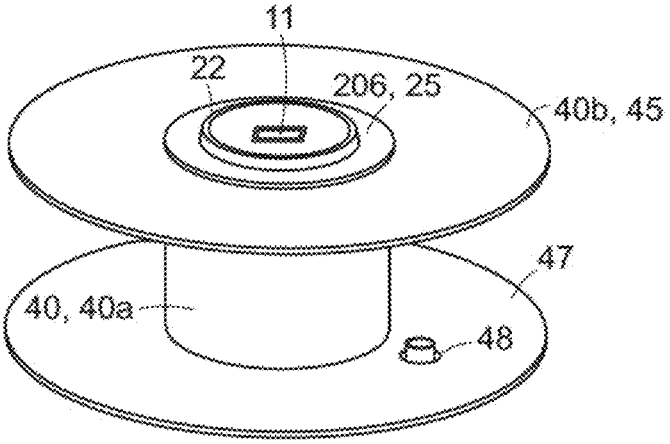
FIG. 3 is a first perspective view of an air compressor of the system.
Figure 4:
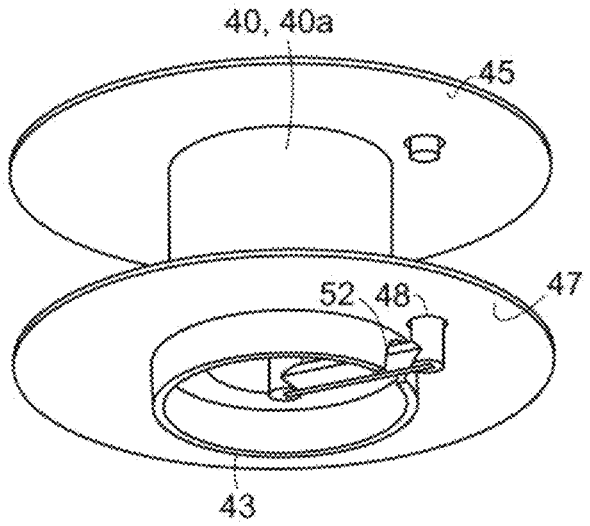
FIG. 4 is a second perspective view of the air compressor.
Figure 5:
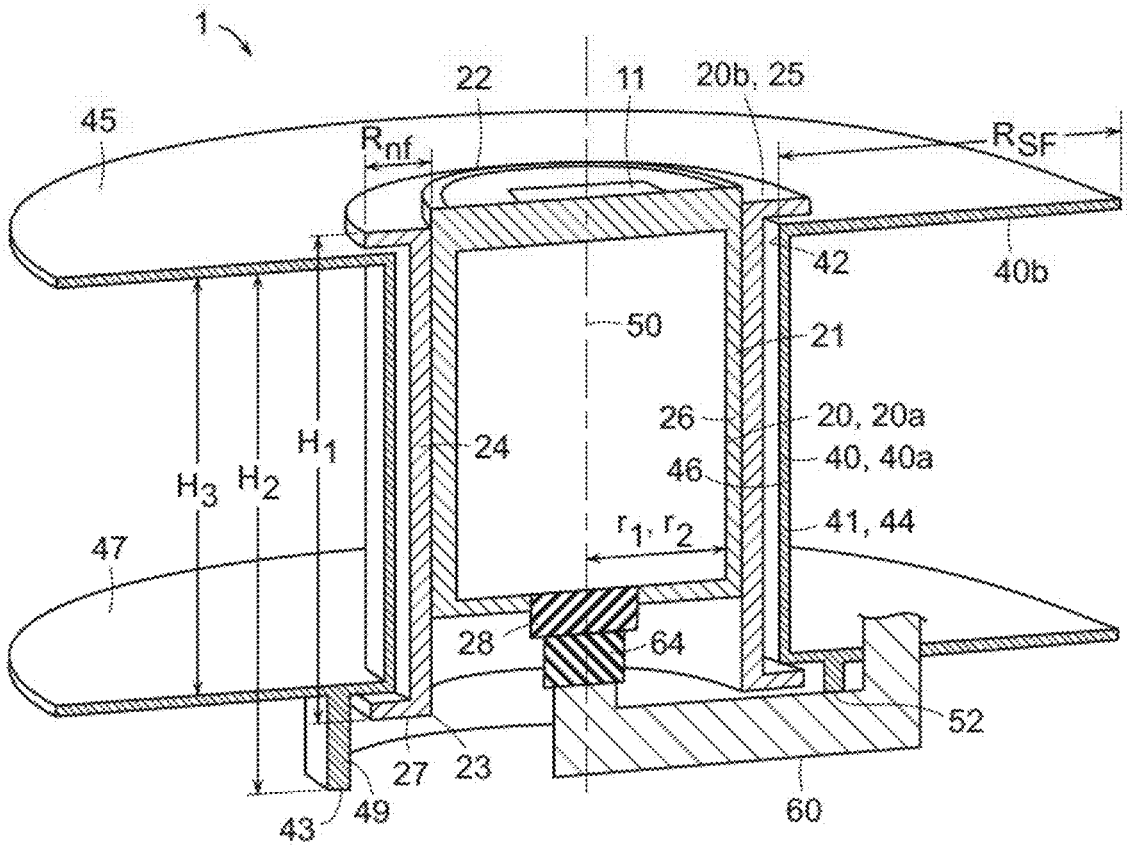
FIG. 5 is a cross-sectional view of the air compressor as seen along line 5-5 of FIG. 1.
Figure 6:
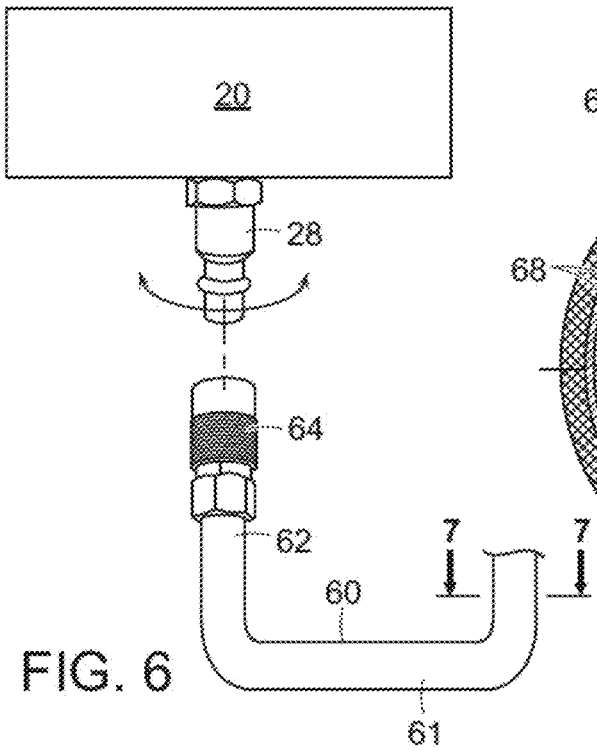
FIG. 6 is a schematic view of the connection between the air compressor and a compressed air storage device of the system.

Referring to FIGS. 1 and 2, a power tool system 15 includes a compressed air-driven power tool 100, an air compressor 1, and a compressed air storage device 60. The power tool 100 may be a hand-held tool such as a nail gun, an impact wrench, an air ratchet, an air hammer, an air drill, an air sander, an air grinder, a spray gun, a staple gun, or any other air driven power tool. The power tool 100 is directly connected to the air compressor 1 via the compressed air storage device 60. In the illustrated embodiment, the compressed air storage device 60 is an elongate, flexible tube 61 that is configured to store air that has been compressed to pressures of 50 to 300 pounds per square inch (PSI) or more and to provide a reservoir for a steady supply of pressurized air to the power tool 100 during tool operation. The air compressor 1 includes a compressor housing 20 that is integrated with a spool 40. The tube 61 is sufficiently flexible to permit coiling about the spool 40, whereby the elongate compressed air storage device 60 can be compactly stored and transported with the air compressor 1. The compressed air storage device 60 can be used in a fully coiled configuration. Alternatively, the compressed air storage device 60 may be used in a partially or fully uncoiled configuration. The air compressor 1 and compressed air storage device 60 will now be described in detail.

Referring to FIGS. 2-5, the air compressor 1 may be a positive displacement compressor such as a provided by a reciprocating piston pump but is not limited to this type of pump. The air compressor 1 includes a compressor housing 20 described in detail below. The compressor housing 20 encloses and/or supports the other components of the air compressor 1, including a compressor pump 2, a motor 5, a controller 10, a human machine interface (HMI) 11, a battery 12, a pressure regulation device 13 and other ancillary components required for operation of the air compressor 1.

In the illustrated embodiment, the compressor pump 2 is a reciprocating piston pump, but may be another type of positive displacement pump. The compressor pump 2 uses one or more reciprocating pistons (not shown) to compress air. The compressor pump 2 includes an air inlet 3 and an air outlet 4.

The air inlet 3 is connected to a compressor air intake valve 6 via a first fluid line 7. The air intake valve 6 is supported on the compressor housing 20. When the air intake valve 6 is in an open position, air in the environment of the compressor 1 (e.g., air at atmospheric pressure) is permitted to enter first fluid line 7. When the air intake valve 6 is in a closed position, air in the environment of the compressor 1 is prevented from entering the first fluid line 7. An air filter 14 may be provided in the first fluid line 7 at a location between the air intake valve 6 and the pump air inlet 3.

The air outlet 4 is connected to a compressor air exhaust valve 8 via a second fluid line 9. The air exhaust valve 8 is supported on the compressor housing 20 and includes an integrated fluid coupling. When the air exhaust valve 8 is in an open position, air that has been compressed by the compressor pump 2 is permitted to exit the compressor housing 20. If the compressed air storage device 60 is coupled to the air exhaust valve fluid coupling, air that has been compressed by the compressor pump 2 is permitted to enter the compressed air storage device 60. When the air exhaust valve 8 is in a closed position, compressed air is prevented from exiting the compressor housing 20.

The pressure regulation device 13 is configured to monitor the output pressure of the air compressor 1. In the illustrated embodiment, the pressure regulation device 13 may be a pressure switch that monitors the pressure of the fluid exhausted from the compressor pump 2 and outputs a signal to the controller indicating the detected pressure. For example, the pressure switch may detect the pressure of the second fluid line 9 at a location between the compressor pump 2 and the compressor exhaust valve 8.

The motor 5 is an electric motor. In some embodiments, the motor 5 may be an induction motor, but is not limited to this type of motor. An output shaft (not shown) of the motor 5 is connected to the compressor pump 2 and motor 5 drives the pump 2 to compress air.

In the illustrated embodiment, a battery 12 is included in the compressor housing 20 and supplies power to the controller 10, which in turn supplies power to the motor 5. The battery 12 may be a rechargeable battery that is charged via a detachable wired connection to utility power. In some embodiments, the air compressor 1 may omit the battery 12 and obtain power via a direct wired connection to utility power. In still other embodiments, the air compressor 1 may include the battery 12 and be capable of being powered by either the battery 12 or direct connection to utility power.

The controller 10 is communicatively coupled with the HMI 11, the battery 12 and the pressure regulation device 13 and is configured to control the motor 5 based on these inputs. As used herein, the term "communicatively coupled" may refer to a direct wired connection via for example electrically conductive signal lines, shared communication busses, or alternatively may refer to a wireless connection. Thus, controller 10 can receive information from these devices and selectively activate and operate the various operational components.

In some embodiments, controller 10 includes one or more memory devices 10*a* and one or more processors 10*b*. The processors 10*b* may be any combination of general or special purpose processors, CPUs, or the like that can execute programming instructions or control code associated with operation of the air compressor 1. The memory devices (i.e., memory) 10*a* may represent random access memory such as DRAM or read only memory such as ROM or FLASH. In some embodiments, the processor 10*b* executes programming instructions stored in memory 10*a*. The memory 10*a* may be a separate component from the processor 10*b* or may be included onboard within the processor 10*b*. Alternatively, the controller 10 may be constructed without using a processor 10*b*, for example, using a combination of discrete analog or digital logic circuitry (such as switches, amplifiers, integrators, comparators, flip-flops, AND gates, and the like) to perform control functionality instead of relying upon software.

In some embodiments, the controller 10 includes a network interface such that the controller 10 can connect to and communicate over one or more networks (not shown). The controller 10 may also include one or more transmitting, receiving, or transceiving components for transmitting and/or receiving communications with other devices communicatively coupled with the air compressor 1. Additionally, or alternatively, the transmitting, receiving, or transceiving components can be located off board controller 10. Generally, the controller 10 may be positioned in any suitable location throughout the compressor housing 20.

The various functions performed by the controller 10 may be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

The compressor housing 20 includes a housing central portion 20*a* that is configured to house and/or support the components of the air compressor 1. The compressor housing 20 also includes a housing peripheral portion 20*b* that disposed radially outward with respect to the housing central portion 20*a* and supports the spool 40.

The central portion 20*a* of the compressor housing 20 includes a hollow first cylindrical portion 21 that receives and supports the compressor pump 2, the motor 5, the air filter 14, the pressure regulation device 13, the HMI 11, the controller 10, the air intake and exhaust valves 6, 8 and any ancillary components needed for compressor operation. The first cylindrical portion 21 includes a housing first end 22, a housing second end 23 that is opposite the housing first end 22, and a cylindrical housing sidewall 24 that extends axially between the housing first end 22 and the housing second end 23. The housing sidewall 24 has a uniform diameter between the housing first and second ends 22, 23. A height dimension H1 of the first cylindrical portion 21 corresponds to a distance between the housing first end 22 and the housing second end 23.

The HMI 11 is mounted on the housing first end 22 and may include switches or other input devices and/or a display. The HMI 11 is configured to permit the user to operate the air compressor 1 and receive information about air compressor performance. In some embodiments, the display may be colored, non-colored (e.g., gray-scale), or a combination of both. The display may be implemented as any type of display including a liquid crystal display (LCD), light emitting diodes (LED), organic light emitting diodes (OLED) or any other alternative configuration known to one of ordinary skill in the art. The display may provide touch-screen functionality and an air pressure level selector may be integrated into the HMI 11.

The air exhaust valve 8 terminates in a hose coupling 28 that protrudes from the compressor housing 20 adjacent to the housing second end 23. The hose coupling 28 is configured to provide a fluid tight mechanical connection to a first coupling 64 of the air storage device 60. In addition, in some embodiments, the hose coupling 28 may include 360 degree, bidirectional swivel functionality such that the air storage device 60 is capable of rotation relative to the compressor.

The peripheral portion 20*b* of the compressor housing 20 includes a housing first flange 25 and a housing second flange 27. The housing first flange 25 is disposed between the housing first end 22 and a mid-height 26 of the first cylindrical portion 21. The housing first flange 25 is a rigid annular structure that protrudes outward from the housing sidewall 24 and extends along the circumference of the housing sidewall 24. The housing second flange 27 is disposed between the mid-height 26 of the first cylindrical portion 21 and the housing second end 23. In the illustrated embodiment, the housing first and second flanges 25, 27 completely encircle the housing sidewall 24. In other embodiments, the housing first and second flanges 25, 27 partially encircle the housing sidewall 24.

In the illustrated embodiment, the housing first flange 25 is disposed below but closely adjacent to the housing first end 22, while the housing second flange 27 is disposed at the housing second end 23.

The radial dimension $R_{hf}$ of the housing first and second flanges 25, 27 is small relative to the height $H_1$ of the first cylindrical portion 21. For example, the first cylindrical portion height $H_1$ is at least four times the radial dimension $R_{hf}$ of the housing first and second flanges 25, 27.

The spool 40 is rotatably supported on the compressor housing 20. Like the compressor housing 20, the spool 40 includes a spool central portion 40*a* that encircles the housing central portion 20*a*. The spool 40 also includes a spool peripheral portion 40*b* that is disposed radially outward with respect to the spool central portion 40*a* and is disposed between the housing first and second flanges 25, 27 in an axial direction of the compressor housing 20.

The spool central portion 40*a* includes a hollow second cylindrical portion 41 that surrounds the housing sidewall 24 in a sliding fit. The second cylindrical portion 41 is concentric with the first cylindrical portion 21. The second cylindrical portion 41 includes a spool first end 42, a spool second end 43 that is opposite the spool first end 42, and a cylindrical spool sidewall 44 that extends between the spool first end 42 and the spool second end 43. The spool sidewall 44 is concentric with the housing sidewall 24. The spool sidewall 44 has a non-uniform diameter between the spool first and second ends 42, 43. In particular, the spool second end 43 has a greater diameter than the spool first end 42. The height dimension H2 of the second cylindrical portion 41 corresponds to a distance between the spool first end 42 and the spool second end 43. The transition between diameters occurs at a location between a mid-height 46 of the second cylindrical portion 41 and the spool second end 43. The height H2 of the second cylindrical portion 41 is greater than the height H1 of the first cylindrical portion.

The peripheral portion 40*b* of the spool 40 includes a spool first flange 45 and a spool second flange 47. The spool first flange 45 is disposed between the spool first end 42 and the mid-height 46 of the second cylindrical portion 41. The spool first flange 25 is a rigid annular structure that protrudes outward from the spool sidewall 44 and extends along the circumference of the spool sidewall 44. The spool second flange 47 is disposed between the mid-height 46 of the second cylindrical portion 41 and the spool second end 43. In the illustrated embodiment, the spool first and second flanges 45, 47 completely encircle the spool sidewall 44. In other embodiments, the spool first and second flanges 45, 47 partially encircle the spool sidewall 44.

In the illustrated embodiment, the spool first flange 45 is disposed at the spool first end 42, while the spool second flange 47 is spaced apart from the spool second end 43. In particular, the spool second flange 47 is disposed at the transition between diameters of the second cylindrical portion 41. In the illustrated embodiment, the transition and the spool second flange 47 is closer to the spool second end 43 than to the second cylindrical portion mid-height 46. This configuration provides an annular stand-off 49 that elevates the spool second flange 47 relative to a support surface such as a table top or floor. The stand-off 49 provides sufficient spacing to accommodate and encircle the protruding hose coupling 28. In addition, the stand-off 49 provides spacing to permit the tube 61 that forms the air storage device 60 to pass between the spool second flange 47 and the support surface. To this end, the spool sidewall 44 includes a radially extending through hole or slot 52 that permits passage of the tube 61 therethrough.

The spool 40, including the spool first flange 45, the second cylindrical portion 41 and the spool second flange 47, is disposed between the housing first flange 25 and the housing second flange 27. The outer surface of the first cylindrical portion 21 serves as a bearing surface, and the spool 40 rotates relative to the first cylindrical portion 21 about a rotational axis 50. References herein to direction such as axial and radial are made with respect to the rotational axis 50. Rotation of the spool 40 relative to the first cylindrical portion 21 facilitates winding of the air storage device onto the compressor housing 20.

The radial dimension $R_{sf}$ of the spool first and second flanges 45, 47 may be approximately the same as the height $H_2$ of the second cylindrical portion 41. For example, the second cylindrical portion height $H_2$ may be in a range of 0.5 times to 1.5 times the radial dimension $R_{sf}$ of the spool first and second flanges 45, 47.

The spool second flange 47 includes an axially-extending through hole 48 that is shaped and dimensioned to receive the tube 61 in a clearance fit.

Referring to FIGS. 2 and 5-7, the air storage device 60 is an elongated tube 61 having a device first end 62 that is detachably coupled to the hose coupling 28 of the air exhaust valve 8 via a device first coupling 64 and a device second end 63 that is opposite the device first end 62. The device second end 62 includes a device second coupling 65. The device first coupling 64 is configured to be detachably connected to the hose coupling 28 of the air compressor 1 in a fluid-tight manner, for example using a quick connect type connector. Similarly, the device second coupling 65 is configured to be detachably connected to the tool coupling 102 in a fluid tight manner, for example using a quick connect type connector.

The tube 61 is elongated. In particular, the tube diameter d is much smaller than a length (not shown) of the tube 61, where the length of the tube corresponds to a distance between the tube first and second ends 62, 63. The tube length is at least 10 times the diameter d of the tube 61. In some embodiments, the tube length is more than 50 times the diameter d of the tube 61. The tube 61 has sufficient flexibility to bend into a loop having a radius r1 that is less than or equal to a radius r2 of the housing sidewall 24. The size and capacity of the tube 61 may depend on factors such as the output capacity of the air compressor 1, the required air pressure, and the specific application's air demand (for example, the pressure required by the power tool 100). In some embodiments, the air storage device 60 has sufficient capacity to handle the required tool operating pressure and to provide sufficient storage capacity to meet the needs of the compressed air system. Increasing tube interior space volume by providing a tube 61 of increased length is one way to accomplish this. The tube 61 has an interior volume that is sufficient to power a pneumatic power tool, which may require a storage capacity of eight liters or more to maintain a high airflow applications. However, most pneumatic tools are operable at lower capacities. Nail guns, for example, may be operable using a one liter capacity or less, depending on the specific tool, the compressor used and required recharge period. Providing the tube 61 in a coiled configuration permits use of a very long tube 61 while providing a compact air storage configuration.

Figure 7:
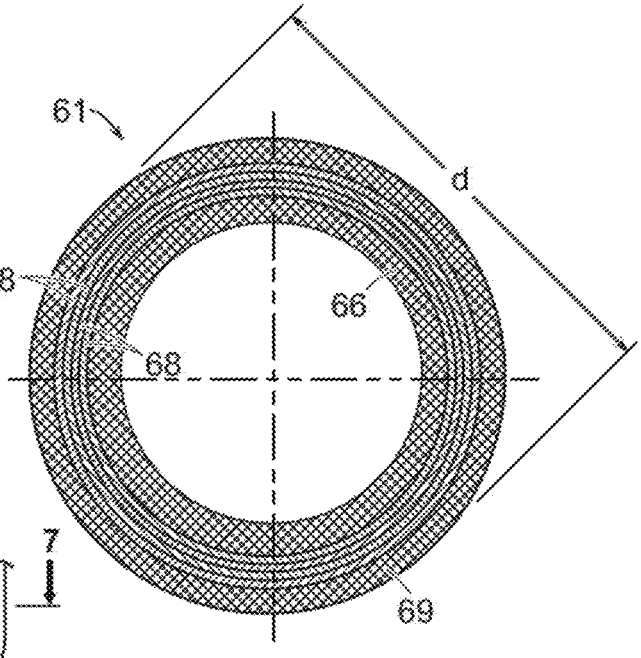
FIG. 7 is a cross-sectional view of the tube of the compressed air storage device as seen along line 7-7 of FIG. 6.

The tube 61 is constructed using multiple layers of materials to ensure durability, flexibility, and resistance to high-pressure air (FIG. 7). In the illustrated embodiment, the tube 61 includes an inner tube 66, at least one reinforcement layer 68 and an outer tube 69. The innermost layer of the tube 61 is the inner tube 66, which is responsible for carrying the compressed air. The inner tube 66 may be made of synthetic rubber or a similar material that can withstand high-pressure air and resist degradation from oil or moisture. The reinforcement layer(s) 68 surround the inner tube 66 and provides strength and stability to the tube 61. In the illustrated embodiment, there are four reinforcement layers 68. Each reinforcement layer is typically made of braided or spiraled synthetic fibers, such as polyester or nylon. The reinforcement layers 68 help the tube 61 withstand the internal pressure cause by compressed air and prevent the tube 61 from expanding or bursting. The outermost layer of the tube 61 is the outer tube 69 or cover, which protects the inner layers 66, 68 from external damage, abrasion, and exposure to the elements. The outer tube 69 is usually made of synthetic rubber or a blend of rubber and other materials. The outer tube 69 is designed to be resistant to oil, chemicals, UV rays, and general wear and tear.

The compressed air storage device first and second couplings 64, 65 are connectors or fittings that allow for easy attachment to the compressor and other pneumatic tools or equipment. The device first and second couplings 64, 65 fittings may be made of brass, steel, or other durable materials and are typically threaded or equipped with quick-connect mechanisms for secure and leak-free connections.

The construction of the tube 61 may vary depending on the specific application, desired flexibility, and the manufacturer's design.

In the power tool system 15, the power tool 100 is directly connected to the air compressor 1 via the compressed air storage device 60. That is to say, the device first coupling 64 is directly connected to the coupling of the air exhaust valve 8 of the air compressor 1 with no intervening structures or devices. In addition, the device second coupling 65 is directly connected to the tool coupling 102 of the power tool 100 with no intervening structures or devices. Moreover, the compressed air storage device 60 stores compressed air for driving the power tool 100 during use.

Selective illustrative embodiments of the compressed air supply system including the air compressor and the air storage device are described above in some detail. It should be understood that only structures considered necessary for clarifying the compressed air supply system have been described herein. Other conventional structures, and those of ancillary and auxiliary components of the compressed air supply system are assumed to be known and understood by those skilled in the art. Moreover, while a working example of the compressed air supply system has been described above, the system is not limited to the working example described above, but various design alterations may be carried out without departing from the system and/or the components thereof as set forth in the claims.

The invention claimed is:

1. An air compressor, comprising:

a compressor housing;

a compressor pump disposed in the compressor housing, the compressor pump having an air inlet and an air outlet;

a motor disposed in the compressor housing, the motor connected to the compressor pump and configured to drive the compressor pump;

a pressure regulation device disposed in the compressor housing;

an air intake valve that is connected to the air inlet of the compressor pump via a first fluid line, the air intake valve configured to selectively permit air flow from an environment of the compressor to the compressor pump; and an air exhaust valve that is connected to the air outlet of the compressor pump via a second fluid line, the air exhaust valve configured to selectively permit air flow from the compressor pump to an air storage device, wherein the compressor housing comprises:

a hollow first cylindrical portion that receives and supports the compressor pump and the pressure regulation device, the first cylindrical portion comprising a housing first end, a housing second end opposite the housing first end, and a cylindrical housing sidewall that extends between the housing first end and the housing second end, a height dimension of the first cylindrical portion corresponding to a distance between the housing first end and the housing second end;

a housing first flange disposed between the housing first end and a mid-height of the first cylindrical portion, the housing first flange protruding outward from the housing sidewall and extending along a circumference of the housing sidewall;

a housing second flange disposed between the housing second end and a mid-height of the first cylindrical portion, the housing second flange protruding outward from the housing sidewall and extending along the circumference of the housing sidewall; and a spool that is rotatably supported on the compressor housing.

2. The air compressor of claim 1, wherein the spool comprises:

a hollow second cylindrical portion that surrounds the housing sidewall, the second cylindrical portion comprising a spool first end, a spool second end opposite the spool first end, and a cylindrical spool sidewall that extends between the spool first end and the spool second end, a height dimension of the second cylindrical portion corresponding to a distance between the spool first end and the spool second end;

a spool first flange disposed between at the spool first end and a mid-height of the second cylindrical portion, the spool first flange protruding outward from the spool sidewall and extending along at least a portion of a circumference of the spool sidewall; and a spool second flange disposed between the spool second end and a mid-height of the second cylindrical portion, the spool second flange protruding outward from the spool sidewall and extending along at least a portion of the circumference of the spool sidewall, wherein the second cylindrical portion is concentric with the first cylindrical portion, and the spool first flange, the second cylindrical portion and the spool second flange are disposed between the housing first flange and the housing second flange.

3. The air compressor of claim 2, wherein the spool second flange includes a through hole that is shaped and dimensioned to receive a tube of a compressed air storage device in a clearance fit.

4. The air compressor of claim 2, wherein the housing second flange is disposed at the housing second end, the spool sidewall includes a first through opening that is disposed between the spool second flange and the spool second end, the spool second flange includes a second through opening, and the first through opening and the second through opening are configured to receive a tube of a compressed air storage device in a clearance fit.

5. The air compressor of claim 1, comprising:

a human machine interface (HMI) that is supported on an outer surface of the housing first end; and a controller disposed in the compressor housing, the controller being electrically connected to the HMI and configured to control operation of the compressor pump based on inputs received from the HMI.

6. The air compressor of claim 1, wherein the second a coupling of the air exhaust valve is a quick connect coupling.

7. The air compressor of claim 1, wherein a coupling permits a 360 degree swivel between the air exhaust valve and a tube coupled to the coupling.

8. The air compressor of claim 1, wherein the air compressor is powered by a rechargeable battery disposed in the compressor housing.

9. The air compressor of claim 1, wherein the air compressor is powered by a wired connection to utility power.

10. An air compressor system, comprising:

a compressor housing;

a compressor pump disposed in the compressor housing, the compressor pump having an air inlet and an air outlet;

a motor disposed in the compressor housing, the motor connected to the compressor pump and configured to drive the compressor pump;

a pressure regulation device disposed in the compressor housing;

an air intake valve that is connected to the air inlet of the compressor pump via a first fluid line, the air intake valve configured to selectively permit air flow from an environment of the compressor housing to the compressor pump;

an air exhaust valve that is connected to the air outlet of the compressor pump via a second fluid line, the air exhaust valve configured to selectively permit air flow from the compressor pump to an air storage device; and the air storage device, wherein the compressor housing comprises:

a hollow first cylindrical portion that receives and supports the compressor pump and the pressure regulation device, the first cylindrical portion comprising a housing first end, a housing second end opposite the housing first end, and a cylindrical housing sidewall that extends between the housing first end and the housing second end, a height dimension of the first cylindrical portion corresponding to a distance between the housing first end and the housing second end;

a housing first flange disposed between the housing first end and a mid-height of the first cylindrical portion, the housing first flange protruding outward from the housing sidewall and extending along a circumference of the housing sidewall; and a housing second flange disposed between the housing second end and a mid-height of the first cylindrical portion, the housing second flange protruding outward from the housing sidewall and extending along the circumference of the housing sidewall, and wherein the air exhaust valve is supported on the housing second end, the air storage device comprises an elongate tube having a device first end that is detachably coupled to the air exhaust valve via a first coupling and a device second end that is opposite the device first end, the device second end comprising a second coupling, and the tube has sufficient flexibility to bend into a loop having a radius that corresponds to a radius of the housing sidewall.

11. The air compressor system of claim 10, comprising a spool that is rotatably supported on the compressor housing, the spool comprising:

a hollow second cylindrical portion that surrounds the housing sidewall, the second cylindrical portion comprising a spool first end, a spool second end opposite the spool first end, and a cylindrical spool sidewall that extends between the spool first end and the spool second end, a height dimension of the second cylindrical portion corresponding to a distance between the spool first end and the spool second end;

a spool first flange disposed between at the spool first end and a mid-height of the second cylindrical portion, the spool first flange protruding outward from the spool sidewall and extending along at least a portion of a circumference of the spool sidewall; and a spool second flange disposed between the spool second end and a mid-height of the second cylindrical portion, the spool second flange protruding outward from the spool sidewall and extending along at least a portion of the circumference of the spool sidewall, wherein the second cylindrical portion is concentric with the first cylindrical portion, and the spool first flange and the spool second flange are disposed between the housing first flange and the housing second flange.

12. The air compressor system of claim 11, wherein the spool second flange includes a through hole that is shaped and dimensioned to receive a tube of a compressed air storage device in a clearance fit.

13. The air compressor system of claim 11, wherein the housing second flange is disposed at the housing second end, the spool sidewall includes a first through opening that is disposed between the spool second flange and the spool second end, the spool second flange includes a second through opening, and the first through opening and the second through opening are configured to receive a tube of a compressed air storage device in a clearance fit.

14. The air compressor system of claim 10, comprising:

a human machine interface (HMI) that is supported on an outer surface of the housing first end; and a controller disposed in the compressor housing, the controller being electrically connected to the HMI and configured to control operation of the compressor pump based on inputs received from the HMI.

15. The air compressor system of claim 10, where the second coupling is a quick connect coupling.

16. The air compressor system of claim 10, wherein the first coupling permits a 360 degree swivel between the air exhaust valve and the tube.

17. The air compressor system of claim 10, wherein the air compressor is powered by a rechargeable battery disposed in the compressor housing.

18. The air compressor system of claim 10, wherein the air compressor motor is powered by a wired connection to utility power.

* * * * *